United States Patent [19]

Korse

[11] 4,290,739

[45] Sep. 22, 1981

[54] HELICAL GEAR PUMP OR GEAR MOTOR WITH OPTIMAL RELIEF GROOVES FOR TRAPPED FLUID

[75] Inventor: Theodorus H. Korse, De Hazelaar 111, 6903 BD Zevenaar, Netherlands

[73] Assignee: Theodorus H. Korse, Delft, Netherlands

[21] Appl. No.: 18,718

[22] Filed: Mar. 8, 1979

[30] Foreign Application Priority Data

Mar. 7, 1978 [DE] Fed. Rep. of Germany ..... 2810563

[51] Int. Cl.[3] ..... F03C 2/08; F04C 2/16; F04C 15/02

[52] U.S. Cl. ..... 418/189; 418/201

[58] Field of Search ..... 418/75, 78, 189, 201, 418/190

[56] References Cited

U.S. PATENT DOCUMENTS

| | | | |
|---|---|---|---|
| 1,129,090 | 2/1915 | Hawley | 418/189 |
| 1,233,069 | 7/1917 | Leonard | 418/189 |
| 1,634,023 | 6/1927 | Davison | 418/201 |
| 1,706,829 | 3/1929 | Thomson | 418/201 |
| 2,147,405 | 2/1939 | Horton | 418/201 |
| 2,338,065 | 12/1943 | Ungar | 418/201 |
| 2,354,992 | 8/1944 | Gottlieb | 418/189 |
| 2,884,864 | 5/1959 | Bobnar | 418/189 |

*Primary Examiner*—John J. Vrablik

[57] ABSTRACT

In an external or internal gear pump or gear motor with one pair of helical spur gears, the trapping of fluid in the enclosed tooth cavity and the risk for cavitation in the said enclosed tooth cavity is considerably reduced by the shift of the pressure port connected and the suction port connected relief grooves at the leading lateral face of the helical gears in the direction of the suction port and the shift of the pressure port connected and suction port connected relief grooves at the lagging lateral face of the helical gears in the direction of the pressure port.

5 Claims, 13 Drawing Figures

HELICAL GEAR PUMP OR GEAR MOTOR WITH OPTIMAL RELIEF GROOVES FOR TRAPPED FLUID

BACKGROUND OF THE INVENTION

The invention relates to hydraulic gear pumps or gear motors with internally or externally meshing helical gears, in which pressure port connected and suction port connected relief grooves have been formed in a special way in the housing and/or the stationary parts, positioned in the pump facing the lateral faces of the helical gears. Known gear pumps with straight gears have the disadvantage, that the enclosed tooth cavity formed in the meshing area changes its volume very quickly, by which the nearly incompressible fluid can enter and leave the tooth cavity only with great difficulty through the relatively small relief areas in the relief grooves. The fluid in the enclosed tooth cavity s considerably compressed and decompressed in spite of possibly theoretically well-dimensioned relief grooves, which cause pressure pulsations, cavitation and noise. Concerning the normally used straight gears, this phenomenon cannot be avoided, because the size of the relief area as a function of the rotation angle of the driving gear cannot be larger than when optimally dimensioned relief grooves are used, i.e. grooves, which have been positioned in the meshing area, approximately symmetrically with respect to the plane through the two rotation axes, preferably at both lateral faces of the gears. To achieve a considerably reduced fluctuation in the rate of flow and of torque, a well-known method is to decrease the tooth clearance to zero or nearly zero. By zero should be understood a tooth clearance that is less than the normal tooth clearance of say 0.3 mm. Besides the landwidth between the pressure port connected and the suction port connected relief grooves has been reduced to half the value. Even more acutely than with a gear pump with tooth clearance the problem of trapped fluid and cavitation presents itself.

SUMMARY OF THE INVENTION

The primary object of the invention is to provide new means by which the available relief area of the gear pump becomes so large, that the fluid can easily enter and leave the tooth cavity without the risk of trapping the fluid or causing cavitation. This problem has been solved in the invention in that the pressure port connected and the suction port connected relief grooves at the leading lateral face of the helical gears have been shifted out of the symmetrical position with respect to the plane through the two rotation axes a distance V/2 perpendicular to said plane in the direction of the suction port and that the pressure port connected and the suction port connected relief grooves at the lagging lateral face of the helical gears have been shifted out of the symmetrical position with respect to the plane through the two rotation axes a distance V/2 perpendicular to said plane in the direction of the pressure port. Thus the pressure port connected and the suction port connected relief grooves at the leading lateral face of the helical gears have been shifted a distance V in the direction of the suction port with respect to the pressure port connected respectively the suction port connected relief grooves at the lagging lateral face. With respect to the landwidth of a comparable pair of straight gears with an identical transversal section the land width of said helical gears is unaltered. The extent of the shift of the relief grooves is independent from the fact whether or not there is a tooth clearance. The technical progress, attainable with the invention is based on several advantages. In particular, when compared to a comparable pair of straight gears, the size of the available relief area in the relief grooves is much larger and besides fluid can also enter and leave the enclosed tooth cavity through gaps between the toothflanks positioned just outside the mechanical meshing area. Only by this alteration it is possible, that the displacement can take place without disturbance, the theoretical fluctuation in the rate of flow being minimal and also that fluid can easily enter and leave the enclosed tooth cavity with no risk of trapping fluid or causing cavitation. This helical gear pump has a very low noise level because not only the hydraulic but also the mechanical noises have considerably been reduced.

BRIEF DESCRIPTION OF THE DRAWINGS

The invention has been shown in the figures in different embodiments:

Referring to the figures the present invention has been illustrated in connection with a gear pump, but it should be understood that the invention may be utilized in connection with a gear motor as well. The gear pump as shown in FIGS. 1,2,3, has a housing 1, that has been closed at both sides by coverplate 2 and 3. In the housing 1 there is a cylindrical aperture 4 that is formed by two intersecting bores 5 and 6. Aperture 4 has the shape of an eight. In bore 5 a driving helical spur gear 11 and two bearing bodies 7 and 8 with bearing bushes 9 and 10 have been positioned. In the same way in bore 6 the driven helical spur gear 16 and two bearing bodies 12 and 13 with bearing bushes 14 and 15 have been positioned. The gear pump conform FIG. 1*a* consists of a housing 1*a* with coverplate 2*a*. The helical spur gears 11 and 16 are pivoted by means of the concerning shafts in the housing 1*a* and coverplate 2*a*. The teeth of the driving helical spur gear are sloping rightward. The teeth of the driven helical spur gear are sloping leftward. The driving gear 11 rotates clockwise. In the bearing bodies 7 and 12 at the leading lateral face 17 of the helical spur gears and in the bearing bodies 8 and 13 at the lagging lateral face 18 of the helical spur gears, relief grooves 19,20,21 and 22 have been positioned in the meshing area in such a way that (a) with decreasing volume of the enclosed tooth cavity the enclosed tooth cavity is connected with the pressure port via the relief grooves 19 and 21, which have been shifted over a distance V with respect to each other and that (b) with increasing volume of the enclosed tooth cavity the enclosed tooth cavity is connected with the suction port via the relief grooves 20 and 22, which have also been shifted over a distance V with respect to each other. Since the size of the area of the enclosed tooth cavity, considered in the transversal plane through the middle of the gears, decreases with decreasing volume of the enclosed tooth cavity, and the size of the area of the enclosed tooth cavity, considered in the transversal plane through the middle of the gears, increases with increasing volume of the enclosed tooth cavity, it can be determined very accurately with what rotation angle of the driving gear 11 the enclosed tooth cavity reaches its minimum, and when the socalled pressure commutation phenomenon will have to take place. For a pair of helical spur gears with tooth clearance FIG. 4 shows in what way the relief grooves 19,20,21,22 have to be dimensioned; The center distance extends from center $M_1$ of the driving helical spur gear 11 with right sloping teeth to center $M_2$ of the driven helical spur gear 16 with left sloping teeth. In the middle of the line connecting the centers $M_1$ and $M_2$ is the kinematic pole P. The thinly drawn line 23 represents the contours of the gears at the lagging lateral face 18 at the frontside of the helical gears. The thin dot-and-dash line 24 represents the contours of the gears at the leading lateral face 17 at the backside of the helical gears. The thick line 25 represents the contours of the helical gears in the transversal plane through the middle of the gears. The helical gears have been represented in a position, where the enclosed tooth cavity reaches its minimum volume or where the size of the shaded area of the enclosed tooth cavity 26, considered in the transversal plane through the middle of the gears, reaches its minimum. It is exact in this position, that the pressure commutation phenomenon takes place, i.e. the tooth cavity is cut off from the pressure port and is connected with the suction port. On the basis of the position of the teeth of the helical gears, in the instant that pressure commutation takes place, the relief grooves of the helical spur gears are dimensioned. In that way the straight landedges 27 and 28 of the somewhat rectangular relief grooves 19 and 20, positioned at the leading lateral face 17 of the helical gears, run parallel with the line of centers through the two contact points 30 and 31, which are situated on the pressureline 29 in the lateral face 17. In the same way the straight land edges 32 and 33 of the somewhat rectangular relief grooves 21 and 22, positioned at the lagging lateral face 18 of the helical gears, run parallel with the line of centers through the two contactpoints 34 and 35, which are situated on the pressureline 29 in the lagging lateral face 18. The line of symmetry 88 belonging to the land edges 27, 28 has been shifted out of the plane through the two rotationaxes over a distance V/2 in the direction of the suction port and the line of symmetry 89 belonging to the land edges 32, 33 has been shifted out of the plane through the two rotation axes over a same distance V/2 in the direction of the pressureport. In FIG. 3 are represented the relief grooves 19,21 and 20,22, which have been shifted over a distance V with respect to each other. The depth 36 of the relief grooves 19,20,21,22 is some millimeters and the width 37 of the relief grooves 19,20,21,22 is approximately the same as the tooth height. The relief grooves 19 and 20 or 21 and 22, positioned at the lateral faces of the helical spur gears are separated by a land having the width 38. The landwidth 38 has the same size as the landwidth 39 of a pair of straight spur gears with the identical transversal section (FIG. 5). In order to compare the extremely increased size of the relief area of the pair of helical spur gears with the relief area of a comparable pair of straight spur gears with an identical transversal section, for the same rotation angle $\phi_1$ the available relief areas of a pair of helical spur gears are shaded in FIG. 6 and the available relief areas of a pair of straight spur gears are shaded in FIG. 5. In FIG. 5 the relief area 40 is available at both lateral faces of the straight spur gears. In FIG. 6 for the same rotation angle $\phi_1$ the relief area 41 at the leading lateral face 17 and the relief area 42 at the lagging lateral face 18 are available. Furthermore there is available for relief the gap 43. Therefor the gear pump or gear motor with helical spur gears and the relief grooves 19,20,21,22, according to the invention, has a larger relief area and for that reason a better relief of the toothcavity than the comparable gear pump or gear motor with straight gears. Of course, the relief grooves 19,20,21,22 at the lateral faces 17,18 of the helical spur gears may have a some what different shape. However the relief grooves must always be dimensioned in such a way, that the enclosed tooth cavity is connected via the relief grooves 19,21, positioned at the side of the pressure port, with the pressure port, only with decreasing size of the area of the tooth cavity, considered in the transversal plane through the middle of the gears, and that the enclosed tooth cavity is connected via the relief grooves 20,22, positioned at the side of the suction port, with the suction port, only with increasing size of the area of the tooth cavity, considered in the transversal plane through the middle of the gears. The modified embodiment of the invention as shown in FIG. 7 is based on the somewhat rectangular relief grooves 19,20,21,22 with straight land edges 27,28,32,33. In the land somewhat triangular notches have been formed which, starting from the intersectionpoint of the land edges 27,25,32,33 with the pressureline 29, follow the contours of the tooth along the foot in the direction of the most adjacent root circle and of said rootcircle for a rotation angle $\phi_1$, for which the size of the area of the enclosed tooth cavity, considered in the transversal plane through the middle of the gears, reaches its minimum. In the same way the size of the relief area of a gear pump or gear motor with no or nearly no tooth clearance can be much increased by the shift, conform the invention, of the relief grooves at the leading lateral face out of the symmetrical position in respect to the plane through the two rotationaxes over a distance V/2 in the direction of the suction port, and by the shift, conform the invention, of the relief grooves at the lagging lateral face out of the symmetrical position with respect to the plane through the two rotation axes over a distance V/2 in the direction of the pressure port. FIGS. 8 and 9 show, that the landwidth 77 is the same as the landwidth 54 of the comparable pair of straight spur gears with no or nearly no tooth clearance. In order to obtain a maximum relief area and an undisturbed pressure commutation, the relief grooves have to be dimensioned in such a way, that only with decreasing volume of an enclosed tooth cavity the enclosed tooth cavity is connected with the pressure port via the relief grooves 55 and 56, which have been shifted over a distance V with respect to each other, and that only with increasing volume of an enclosed tooth cavity the enclosed tooth cavity is connected with the suction port via the relief grooves 57 and 58, which have also been shifted over a distance V with respect to each other. Since the size of the area of an enclosed tooth cavity, considered in the transversal plane through the middle of the gears, decreases with decreasing volume of this enclosed tooth cavity and the size of the area of an enclosed tooth cavity, considered in the transversal plane through the middle of the gears, increases with increasing volume of this enclosed tooth cavity, in the same way as for a pair of helical spur gears with tooth clearance, it can be determined exactly with what rotation angle $\phi_1$ of the driving gear 11 this enclosed tooth cavity reaches its minimum volume and so when the pressure commutation will have to take place. In FIG. 9 has been represented, how the relief grooves 55,56,57,58, according to the invention, of a pair of helical spur gears, meshing with no or nearly no tooth clearance and with the same transversal section as the pair of helical gears with tooth clearance (FIG. 4), have to be dimensioned. The thin line 60 follows the contours of the helical gear at the lagging lateral face 61, at the front side of the helical gear. The thin dot-and-dash line 62 follows the contours of the helical gears at the leading lateral face 63 at the back side of the helical gears. The thick line 64 represents the contours of the helical gears in the transversal plane through the middle of the gears. The helical gears are represented in that position, where an enclosed toothcavity at the side of the driven gear reaches its minimal volume or in which the size of the shaded area 59 of the tooth cavity, considered in the transversal plane through the middle of the gears, is a minimum. It is exactly in this position, that the pressure commutation has to take place, i.e. the toothcavity is cut off from the pressure port and is connected with the suction port. On the basis of the position of the teeth of the helical gears, in the instant when pressure commutation takes place, the relief grooves 55,56,57,58 of the helical spur gears with no or nearly no tooth clearance are dimensioned. In that way, the straight land edges 65 and 66 of the somewhat rectangular relief grooves 56 and 58, positioned at the leading lateral face 63 of the helical gears in the background run parallel with the line of centers and through the two contact points 69 and 70, which are positioned on the pressure lines 68 and 67 (at the leading lateral face 63 in the background). In the same way the straight land edges 71 and 72, positioned at the lagging lateral face 61 of the helical gears in the foreground run parallel with the line of centers and through the two contact points 73 and 74, which are situated on the pressure lines 68 and 67 (in the lagging lateral face 61 in the foreground). The line of symmetry 90, belonging to the land edges 65, 66 has been shifted out of the plane through the two rotationaxes over a distance V/2 in the direction of the suction port and the line of symmetry $y_1$, belonging to the land edges 71,72 has been shifted out of the plane through the two rotation axes over a distance V/2 in the direction of the pressure port. Depth 75 of the relief grooves 55,56,57,58 may be some millimeters. The width 76 of the relief grooves 55,56,57,58 equals approximately the tooth height. The relief grooves 56 and 58 or 55 and 57, positioned at the lateral face of the helical spur gears are separated by a land with width 77. The land with width 77 is unchanged compared to the landwidth 54 of a pair of straight spur gears with no or nearly no tooth clearance with the identical transversal section (FIG. 8). Of course the relief grooves 55,56,57,58 at the lateral faces 61,63 of the helical spur gears may have a somewhat different shape. However the relief grooves must always be dimensioned in such a way, that the enclosed tooth cavity, either at the side of the driving gear or at the side of the driven gear, is connected via the relief grooves 55,56, positioned at the side of the pressure port, with the pressure port, only with decreasing size of the area of the enclosed tooth cavity, considered in the transversal plane through the middle of the gears and that the enclosed tooth cavity, either at the side of the driving gear or at the side of the driven gear, is connected via the relief grooves 57,58, positioned at the side of the suction port, with the suction port, only with increasing size of the area of the enclosed tooth cavity, considered in the transversal plane through the middle of the gears. The modified embodiment of the invention as shown in FIG. 11 and 12 is based on the somewhat rectangular relief grooves 55,56,57,58 with straight land edges 71,65,72,66. In the land somewhat triangular notches 79,81,82,84 have been formed which, starting from the intersection point of the land edges 71,65,72,66 with the pressure lines 67 and 68, follow the contours of the tooth flank along the foot in the direction of the most adjacent rootcircle 87 and of said rootcircle 87 for a rotation angle $\phi_1$ for which the size of the area of the enclosed tooth cavity at the side of the driven gear, considered in the transversal plane through the middle of the gears, reaches its minimum (FIGS. 11 and 12). In the same way in the land somewhat triangular notches 78,80,83,85 have been formed which, starting from the intersection point of the land edges 71,65,72,66 with the pressurelines 67 and 68, follow the contours of the tooth flank along the foot in the direction of the most adjacent rootcircle 86 and of said rootcircle 86 for a rotation angle $\phi_1$ for which the size of the area of the enclosed tooth cavity at the side of the driving gear, considered in the transversal plane through the middle of the gears, reaches its minimum. (This situation has not been shown) By these notches 78,79,80,81,82,83,84,85, according to the invention, the size of the available relief area is considerably increased.

Figure 1:
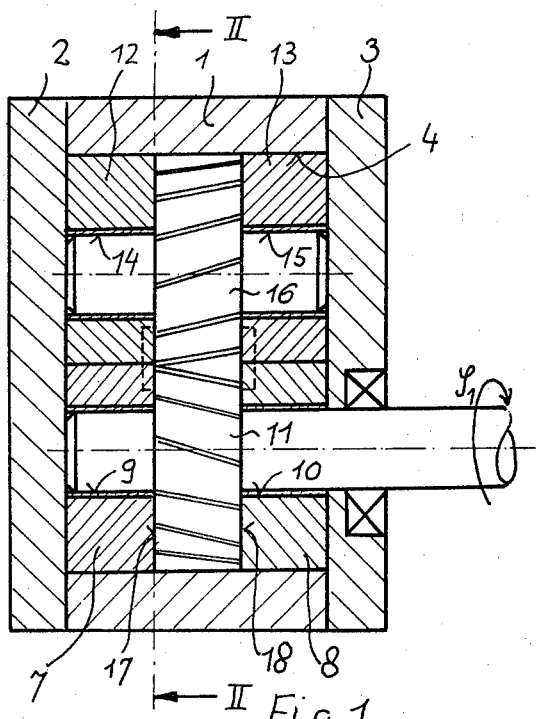
FIG. 1 is the cross-section through I—I of FIG. 2 of the gear pump with tooth clearance.
Figure 2:
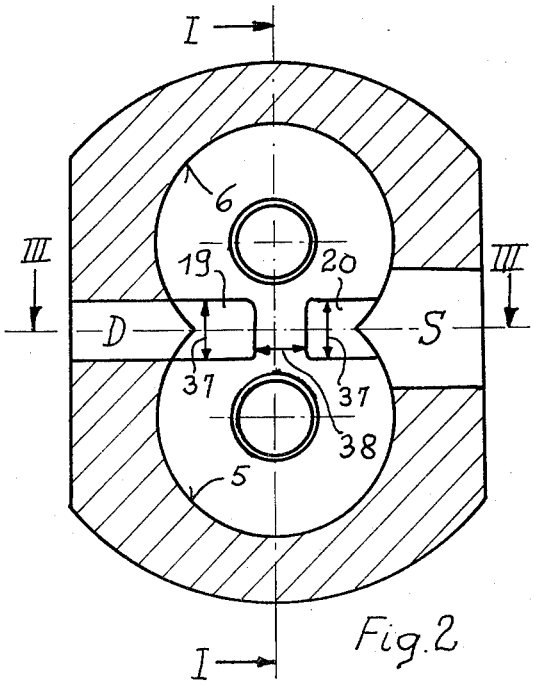
FIG. 2 is the cross-section through II—II of FIG. 1.
Figure 8:
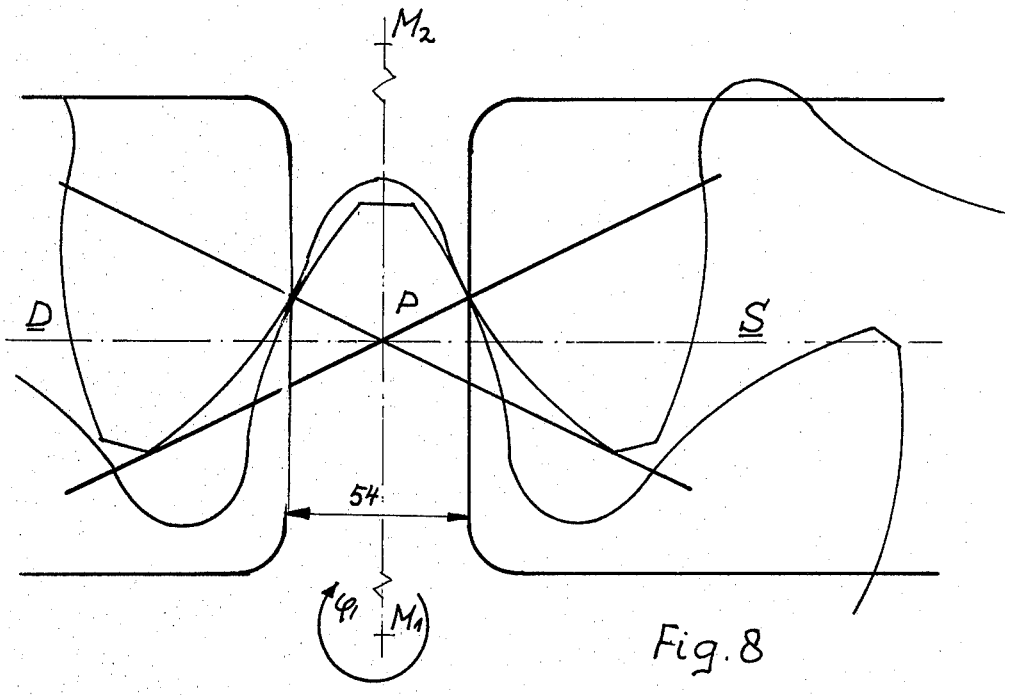
FIG. 8 shows the relief grooves of a pair of straight spur gears with no or nearly no tooth clearance.
Figure 1A:
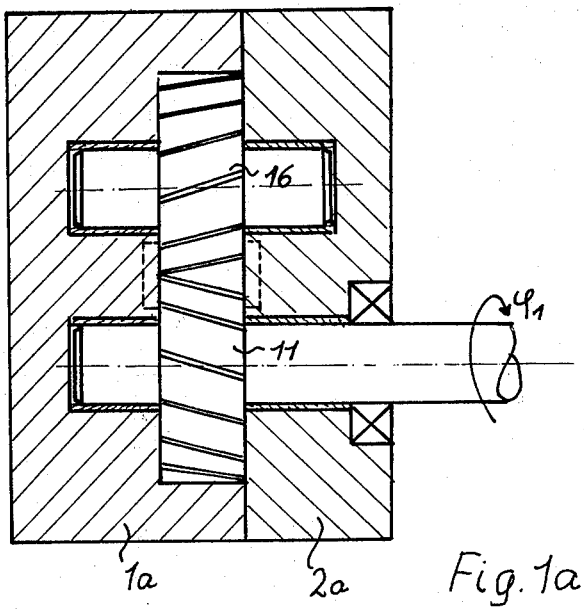
FIG. 1*a* is a modified embodiment of the invention in the cross-section as in FIG. 1.
Figure 3:
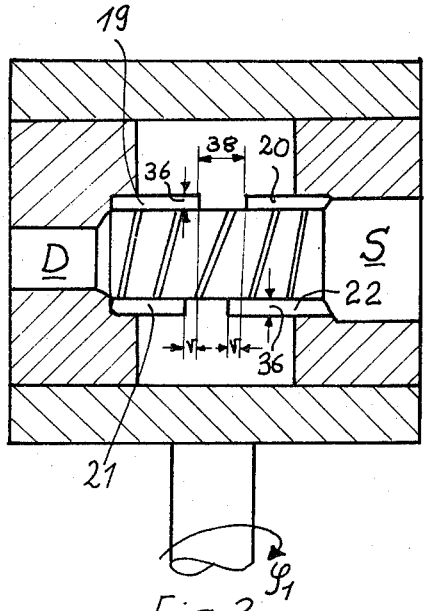
FIG. 3 is the cross-section through III—III of FIG. 2.
Figure 10:
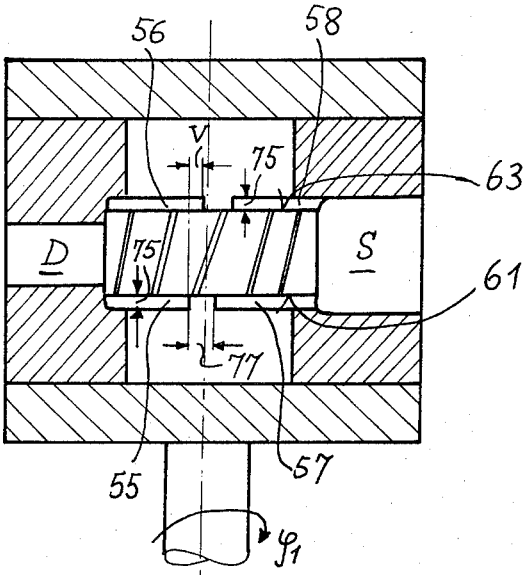
FIG. 10 is the cross-section through III—III of FIG. 2, modified for a comparable pair of helical spur gears with no or nearly no tooth clearance.
Figure 4:
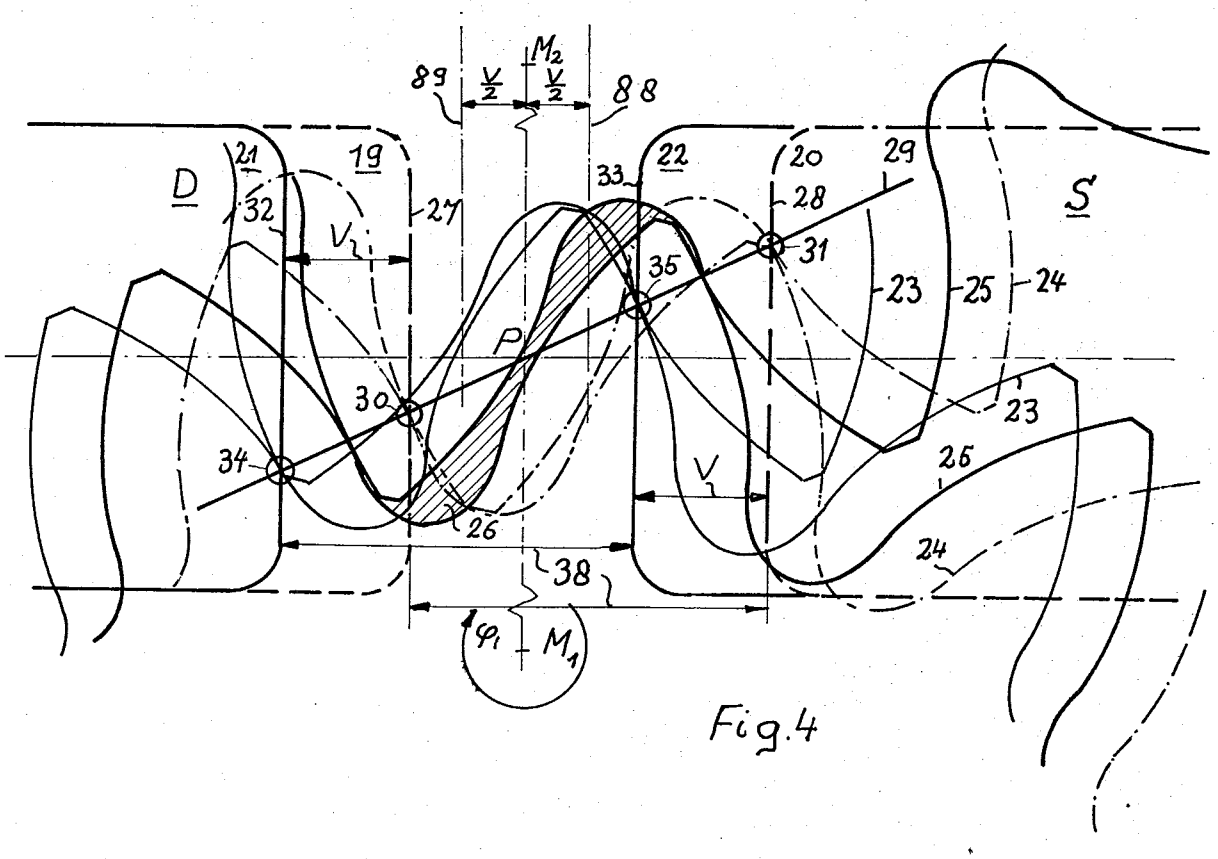
FIG. 4 represents the relief grooves of a pair of helical spur gears with tooth clearance.
Figure 5:
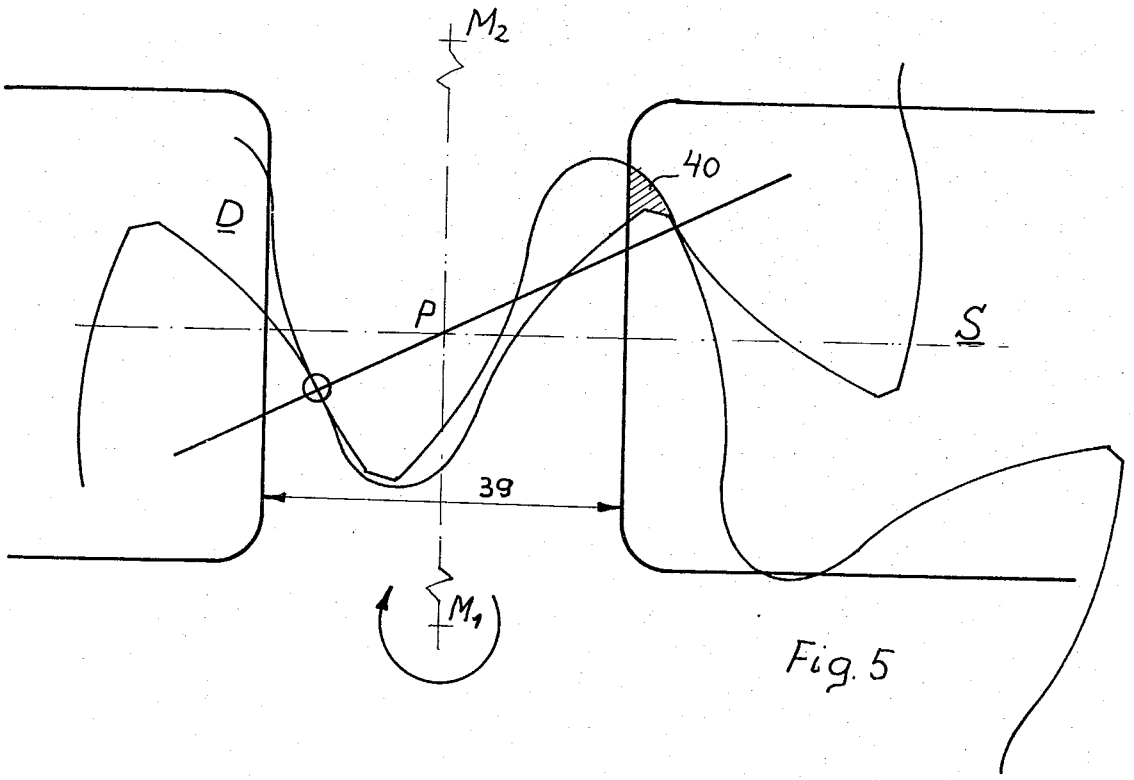
FIG. 5 shows the size of the relief area of a pair of straight spur gears, compared to a pair of helical spur gears as in FIG. 4 for a rotationangle $\phi_1$ of the driving gear.
Figure 6:
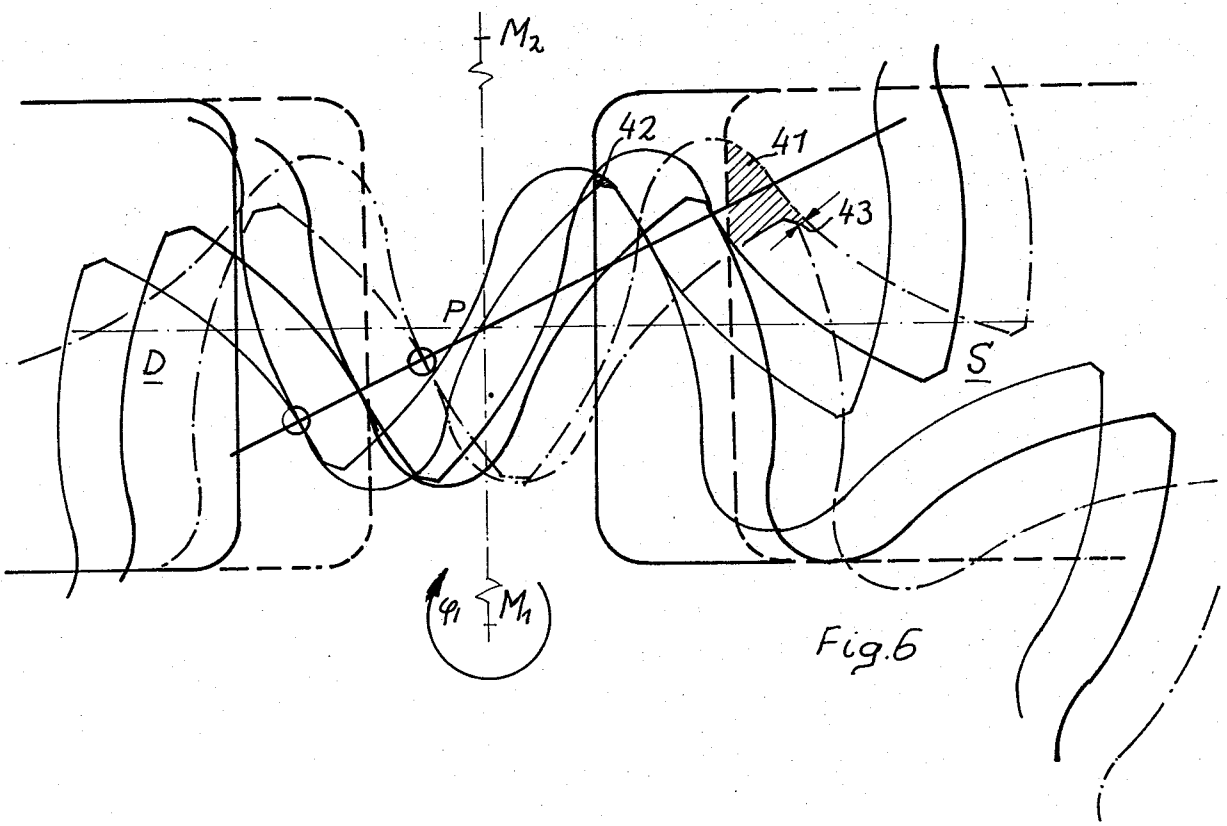
FIG. 6 shows the size of the relief area of a pair of helical spur gears as in FIG. 4 with the same rotationangle $\phi_1$ as in FIG. 5.
Figure 7:
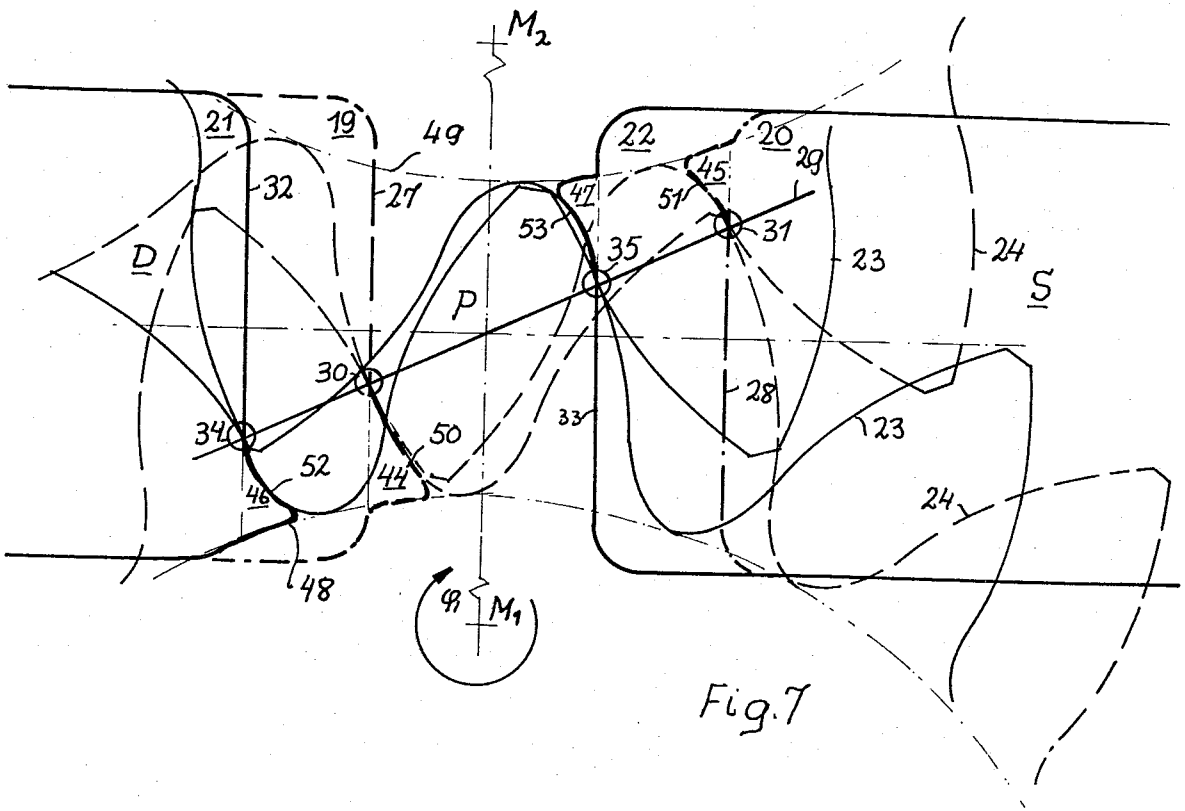
FIG. 7 is a modified embodiment of the relief grooves of FIG. 4.
Figure 9:
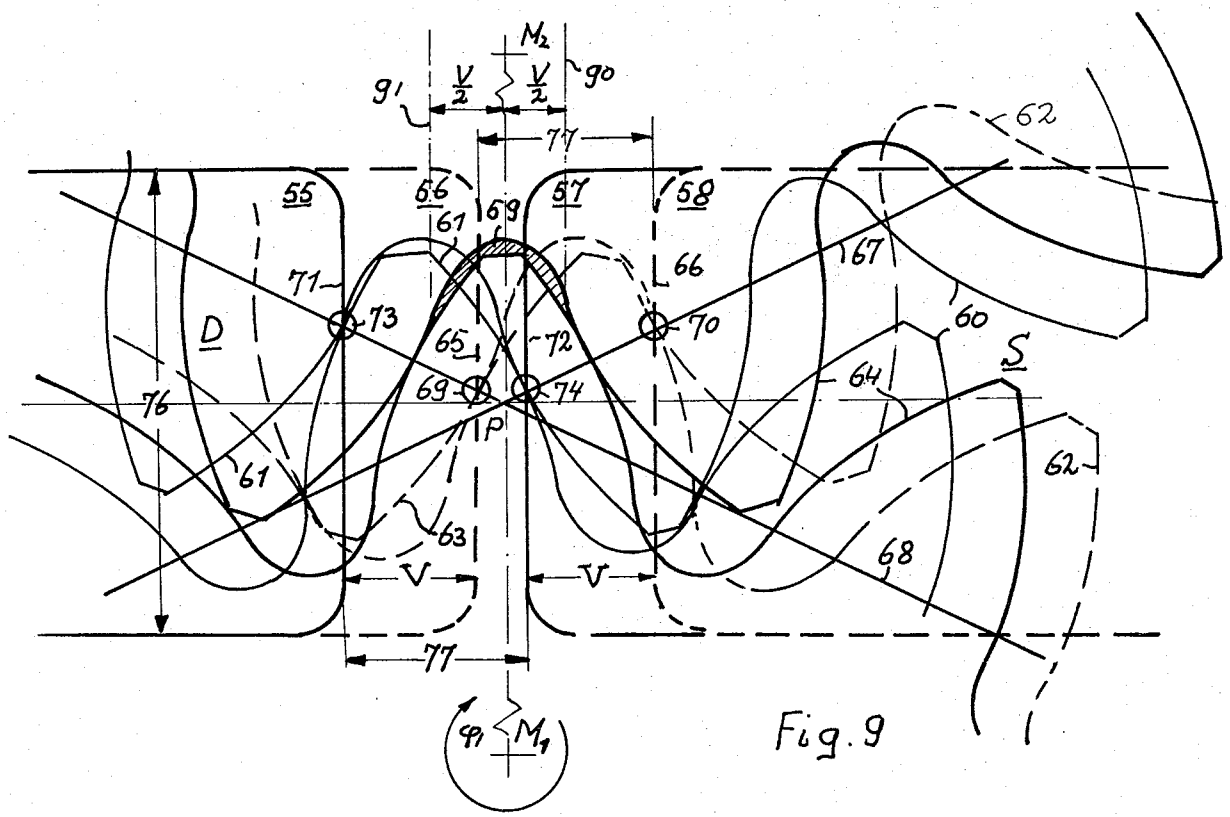
FIG. 9 shows the relief grooves of a pair of helical spur gears with no or nearly no tooth clearance, said helical spur gears being comparable with the straight spur gears as in FIG. 8.
Figure 11:
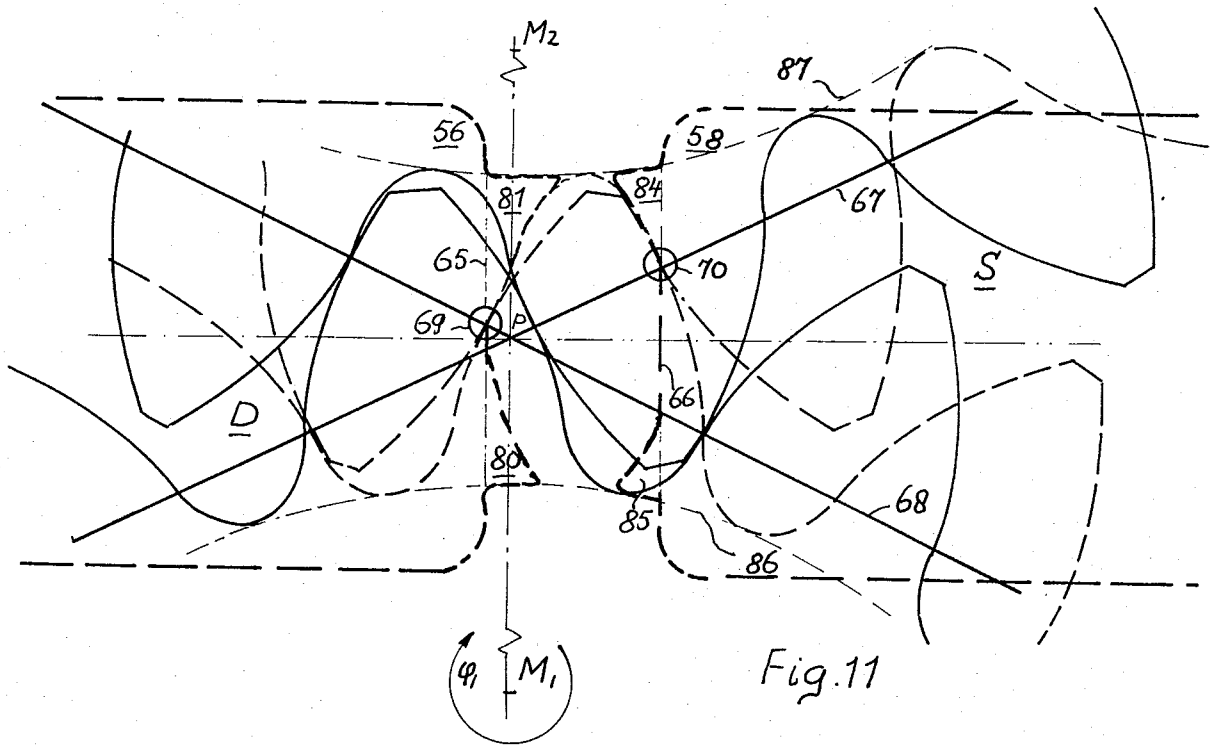
FIG. 11 is a modified embodiment of FIG. 9, viz. of the relief grooves at the leading lateral face of a pair of helical spur gears with no or nearly no tooth clearance
Figure 12:
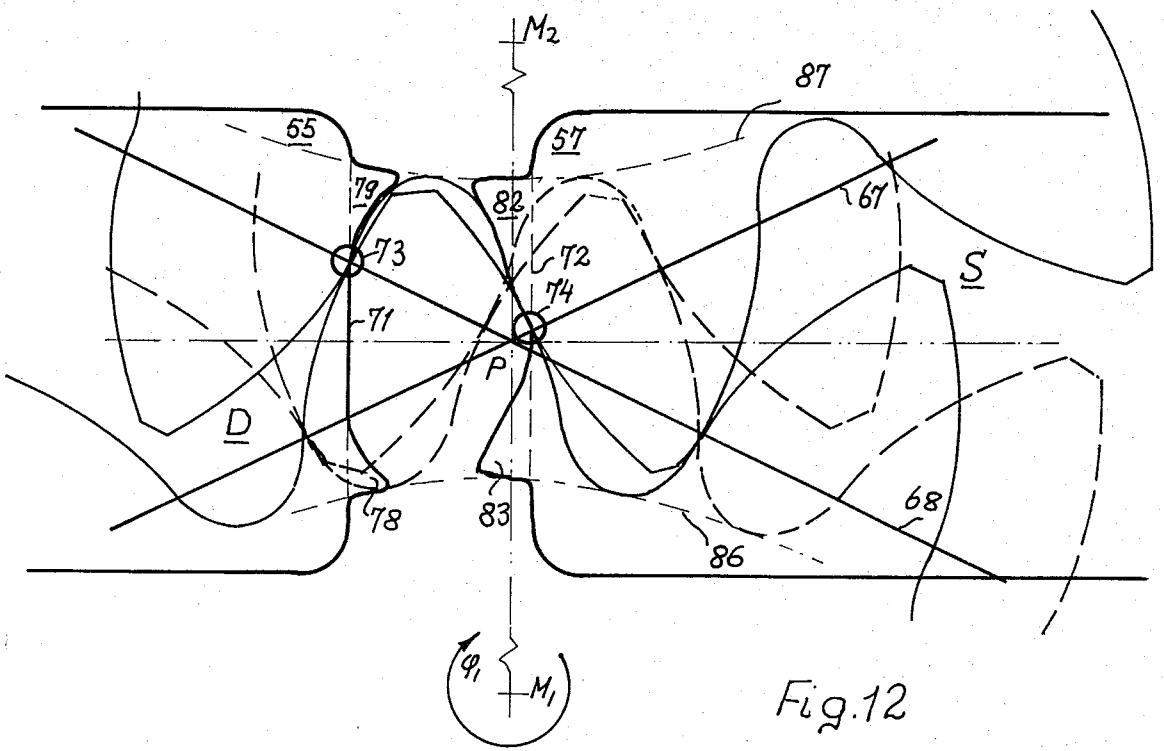
FIG. 12 is a modified embodiment of FIG. 9, viz. of the relief grooves at the lagging lateral face of a pair of helical spur gears with no or nearly no tooth clearance.

What is claimed is:

1. A gear pump or gear motor comprising a pair of intermeshing driving and driven helical gears, a housing surrounding said gears and providing pressure ports and suction ports leading to said gears, pressure port connected and suction port connected relief grooves, formed in the meshing area in the housing and/or the stationary parts, positioned in the pump, said relief grooves facing the lateral faces of the helical gears; said pressure port connected and suction port connected relief grooves at the leading lateral face of the helical gears having been shifted, out of the symmetrical position with respect to the plane through the two rotation axes, over a distance V/2 in the direction of the suction port, said pressure port connected and suction port connected relief grooves at the lagging lateral face of the helical gears having been shifted, out of the symmetrical position with respect to the plane through the two rotation axes, over a distance V/2 in the direction of the pressure port, said distance V/2 having been given that value, that an enclosed tooth cavity is connected via the pressure port connected relief grooves with the pressure port, only with decreasing size of the area of the enclosed tooth cavity, considered in the transversal plane through the middle of the gears and that an enclosed tooth cavity is connected via the suction port connected relief grooves with the suction port, only with increasing size of the area of the enclosed tooth cavity, considered in the transversal plane through the middle of the gears.

2. In a gear pump or gear motor as in claim 1 comprising a pair of helical gears, meshing with tooth clearance; straight land edges of somewhat rectangular relief grooves at the leading lateral face of the helical gears go through the contact points, positioned on the pressureline at said leading lateral face, said land edges running parallel with the line of centers and straight land edges of somewhat rectangular relief grooves at the lagging lateral face of the helical gears go through the contactpoints, positioned on the pressureline at said lagging lateral face, said land edges running parallel with the line of centers, said helical gears being considered for a rotation angle, for which the size of the area of the enclosed tooth cavity, considered in the transversal plane through the middle of the gears, reaches its minimum.

3. A gear pump or gear motor as in claim 1 or 2 wherein in the land somewhat triangular notches have been formed which, starting from the intersection point of a land edge with the pressureline, follow the contours of the toothflank along the foot in the direction of the most adjacent rootcircle and of said rootcircle, said helical gears being considered for a rotation angle, for which the size of the area of the enclosed tooth cavity, considered in the transversal plane through the middle of the gears, reaches its minimum.

4. In a gear pump or gear motor as in claim 1 comprising a pair of helical gears, meshing with no or nearly no tooth clearance;

straight land edges of somewhat rectangular relief grooves at the leading lateral face of the helical gears go through the contact points, positioned on the pressurelines at said leading lateral face, said land edges running parallel with the line of centers and straight land edges of somewhat rectangular relief grooves at the lagging lateral face of the helical gears go through the contact points, positioned on the pressurelines at said lagging lateral face, said land edges running parallel with the line of centers, said helical gears being considered for a rotation angle for which the size of the area of an enclosed tooth cavity at the side of the driving or of the driven gears, considered in the transversal plane through the middle of the gears, reaches its minimum.

5. A gear pump or gear motor as in claim 1 or 4 wherein in the land somehwhat triangular notches have been formed which, starting from a intersectionpoint of a land edge with a pressureline, follow the contours of the toothflank along the foot in the direction of the most adjacent rootcircle and of said rootcircle, said helical gears being considered for a rotation angle for which the size of the area of an enclosed tooth cavity at the side of the driving or of the driven gear, considered in the transversal plane through the middle of the gears, reaches its minimum.

* * * * *

UNITED STATES PATENT AND TRADEMARK OFFICE

CERTIFICATE OF CORRECTION

PATENT NO. : 4,290,739

DATED : September 22, 1981

INVENTOR(S) : Theodorus H. Korse

It is certified that error appears in the above—identified patent and that said Letters Patent is hereby corrected as shown below:

Column 1, line 19, "s" should read -- is --.

Column 5, line 68, "y1" should read -- 91 --.

Column 8, line 25, "gears" should read -- gear --.

Column 8, line 29, "somehwhat" should read -- somewhat --.

Signed and Sealed this

*Fifteenth* Day of *June 1982*

[SEAL]

*Attest:*

GERALD J. MOSSINGHOFF

*Attesting Officer*

*Commissioner of Patents and Trademarks*